US008132888B2

(12) United States Patent
Suzuki

(10) Patent No.: US 8,132,888 B2
(45) Date of Patent: Mar. 13, 2012

(54) INKJET RECORDING APPARATUS AND HEAD MAINTENANCE METHOD

(75) Inventor: Isao Suzuki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 411 days.

(21) Appl. No.: 12/181,945

(22) Filed: Jul. 29, 2008

(65) Prior Publication Data

US 2009/0040250 A1 Feb. 12, 2009

(30) Foreign Application Priority Data

Aug. 1, 2007 (JP) ..... 2007-201106
Jul. 15, 2008 (JP) ..... 2008-183965

(51) Int. Cl.
*B41J 2/165* (2006.01)

(52) U.S. Cl. ..... 347/22; 347/30; 347/36

(58) Field of Classification Search ..... 347/21–23, 347/29–30, 35–36, 84–85, 89
See application file for complete search history.

(56) References Cited

U.S. PATENT DOCUMENTS

2006/0268054 A1* 11/2006 Sugahara ..... 347/35

FOREIGN PATENT DOCUMENTS

| | | |
|---|---|---|
| JP | 11-505481 | 5/1999 |
| JP | 2001-347664 | 12/2001 |
| JP | 2003-127436 | 5/2003 |
| JP | 2004-133970 | 4/2004 |
| JP | 2007-008157 | 1/2007 |
| JP | 2007-193879 | 8/2007 |
| JP | 2007-253537 | 10/2007 |
| JP | 2008-254279 | 10/2008 |

OTHER PUBLICATIONS

Japanese Office Action for 2008-183965 mailed on Jun. 8, 2010.
Japanese Office Action for 2007-206952 Mailed Aug. 31, 2010.
Japanese Office Action for Application No. 2007-201106 mailed on Oct. 25, 2011.

* cited by examiner

*Primary Examiner* — Jason Uhlenhake
(74) *Attorney, Agent, or Firm* — Turocy & Watson, LLP

(57) ABSTRACT

An inkjet recording apparatus includes an inkjet head, a tank in which liquid to be supplied to the inkjet head is retained, and a flow path for connecting the inkjet head and the tank to each other. The inkjet head includes a head main body, liquid chambers which are built in the head main body, and in which liquid is kept under negative pressure, a nozzle plate bonded to the head main body in such a manner that the plate constitutes one wall part of each of the liquid chambers, nozzles formed in the nozzle plate in such a manner that the nozzles communicate with the liquid chambers, drive elements for causing the nozzles to eject liquid droplets, and first suction holes formed in the nozzle plate in such a manner that the holes communicate with the liquid chambers.

7 Claims, 12 Drawing Sheets

INKJET RECORDING APPARATUS AND HEAD MAINTENANCE METHOD

CROSS-REFERENCE TO RELATED APPLICATION

This application is based upon and claims the benefit of priority from prior Japanese Patent Applications No. 2007-201106, filed Aug. 1, 2007; and No. 2008-183965, filed Jul. 15, 2008, the entire contents of both of which are incorporated herein by reference.

TECHNICAL FIELD

The present invention relates to an inkjet recording apparatus for forming an image on a sheet-like recording medium by ejecting liquid droplets, and a head maintenance method.

BACKGROUND

In Jpn. Pat. Appln. KOKAI Publication No. 2003-127436, for example, an inkjet recording apparatus in which an inkjet head is provided with an ink collection port is disclosed. This inkjet recording apparatus includes an inkjet head, wiping means provided with a blade for removing ink adhering to a surface of a nozzle plate, purge means for drawing ink from a nozzle, and performing ink replenishment or disposal, and cap means for protecting the nozzle from dryness when printing is not performed. The inkjet head includes a nozzle for ejecting ink droplets, and an ink collection port provided in the vicinity of the nozzle. The inkjet recording apparatus further includes an ink collection pump connected to an ink collection path. The ink collection port is formed larger than the diameter of the nozzle, and smaller than the thickness of the blade of the wiping means.

In this inkjet recording apparatus, in a maintenance operation of the inkjet head, the blade of the wiping means performs a wiping operation of the nozzle plate. Simultaneously with the wiping operation, the ink collection pump operates. As a result of this, the ink gathered up by the blade is drawn into an ink suction port.

In the conventional inkjet recording apparatus described above, the ink collection pump is required in addition to the general configuration of the apparatus, thereby complicating the structure. Further, the ink collection pump is configured to operate only at the time of the wiping operation of the wiping means, and hence, although improvement in the wiping effect can be expected, there is the problem that the ink collection pump does not always lead to reduction in the number of times of execution of maintenance.

SUMMARY

An object of the present invention is to provide an inkjet recording apparatus capable of making the number of times of execution of maintenance small by a simple structure.

Another object of the present invention is to provide a head maintenance method by which the number of times of execution of maintenance can be made small by a simple structure.

In order to achieve the objects described above, an inkjet recording apparatus according to an aspect of the present invention comprises: an inkjet head; a tank in which liquid to be supplied to the inkjet head is retained; and a flow path for connecting the inkjet head and the tank to each other, wherein the inkjet head includes a head main body; liquid chambers which are built in the head main body, and in which liquid is kept under negative pressure; a nozzle plate bonded to the head main body in such a manner that the plate constitutes one wall part of each of the liquid chambers; nozzles formed in the nozzle plate in such a manner that the nozzles communicate with the liquid chambers; drive elements for causing the nozzles to eject liquid droplets; and first suction holes formed in the nozzle plate in such a manner that the holes communicate with the liquid chambers.

In order to achieve the objects described above, a head maintenance method according to another aspect of the present invention used in an inkjet recording apparatus comprising: an inkjet head including a head main body, liquid chambers which are built in the head main body, and in which liquid is retained, a nozzle plate bonded to the head main body in such a manner that the plate constitutes one wall part of each of the liquid chambers, nozzles formed in the nozzle plate in such a manner that the nozzles communicate with the liquid chambers, for ejecting the liquid as liquid droplets, and suction holes formed in the nozzle plate independently of the liquid chambers; a suction device for drawing extraneous matter adhering to the nozzle plate from the suction hole; and a tub-like head bath in which the inkjet head is dipped, comprises: ejecting liquid from the nozzle toward the inside of the head bath to form a liquid puddle therein; dipping the inkjet head in the liquid puddle; and thereafter drawing the extraneous matter from the suction hole together with the liquid.

In order to achieve the objects described above, an inkjet recording apparatus according to still another aspect of the present invention comprises: an inkjet head for ejecting liquid; a tank in which liquid to be supplied to the inkjet head is retained; and a flow path for connecting the inkjet head and the tank to each other, wherein the inkjet head includes a head main body; liquid chambers which are built in the head main body, and in which liquid is kept under negative pressure; a nozzle plate bonded to the head main body in such a manner that the plate constitutes one wall part of each of the liquid chambers; nozzles formed in the nozzle plate in such a manner that the nozzles communicate with the liquid chambers; drive elements for causing the nozzles to eject liquid droplets; and first liquid collection holes which are provided independently of the nozzles, and are formed in the nozzle plate in such a manner that the holes communicate with the liquid chambers, and the nozzle plate includes liquid-repellent areas formed around the nozzles; a lyophilic area which is formed to surround the liquid-repellent areas, and in which the first liquid collection holes are arranged; and a first groove section which is provided in the lyophilic area to surround the liquid-repellent areas, is formed depressed with respect to a surface of the lyophilic area, and communicates with the first liquid collection holes.

According to the present invention, it is possible to provide an inkjet recording apparatus capable of making the number of times of execution of maintenance small by a simple structure.

Objects and advantages of the invention will become apparent from the description which follows, or may be learned by practice of the invention.

DESCRIPTION OF THE DRAWINGS

The accompanying drawings illustrate embodiments of the invention, and together with the general description given above and the detailed description given below, serve to explain the principles of the invention.

DETAILED DESCRIPTION

Embodiments of the present invention will be described below with reference to the accompanying drawings. An inkjet recording apparatus according to an embodiment ejects liquid droplets toward a sheet-like recording medium such as paper to print characters or images on the recording medium.

Figure 1:
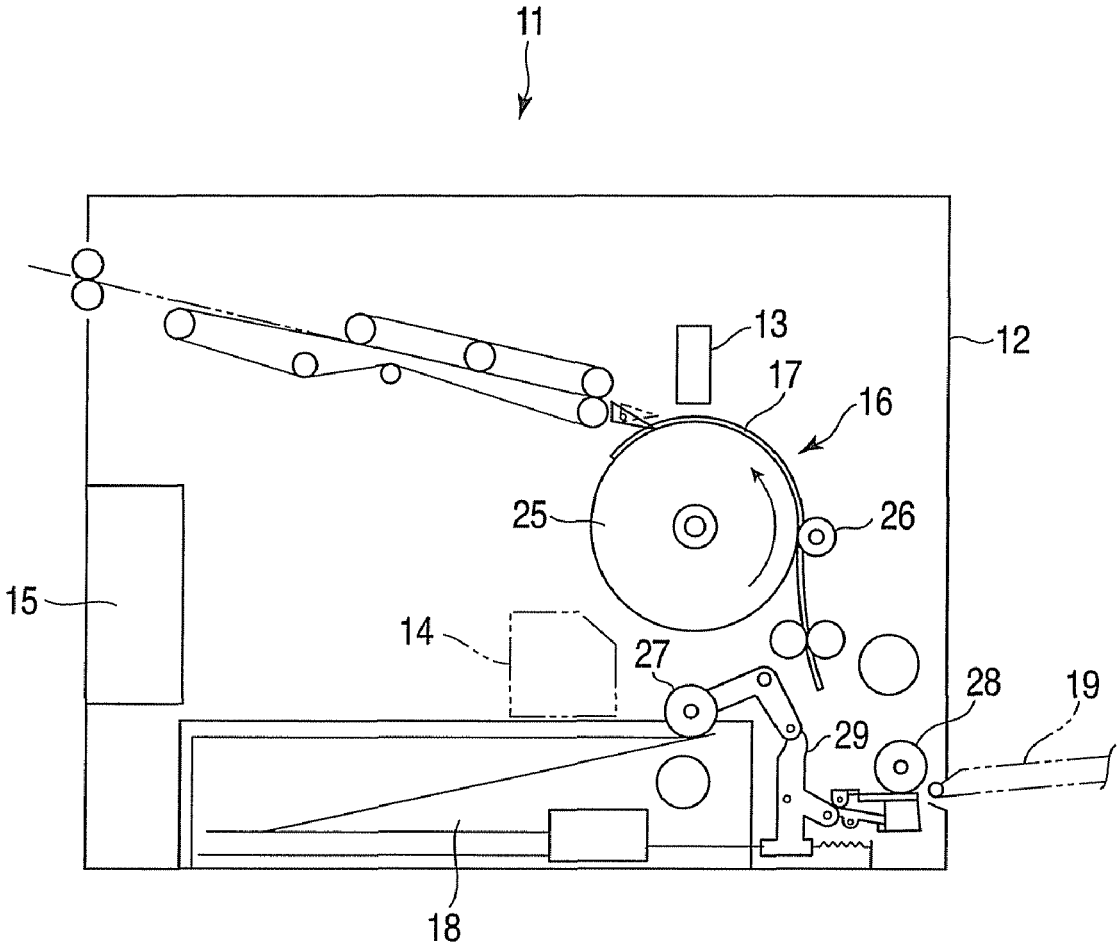
FIG. 1 is a schematic side view showing an inkjet recording apparatus according to a first embodiment.
Figure 2:
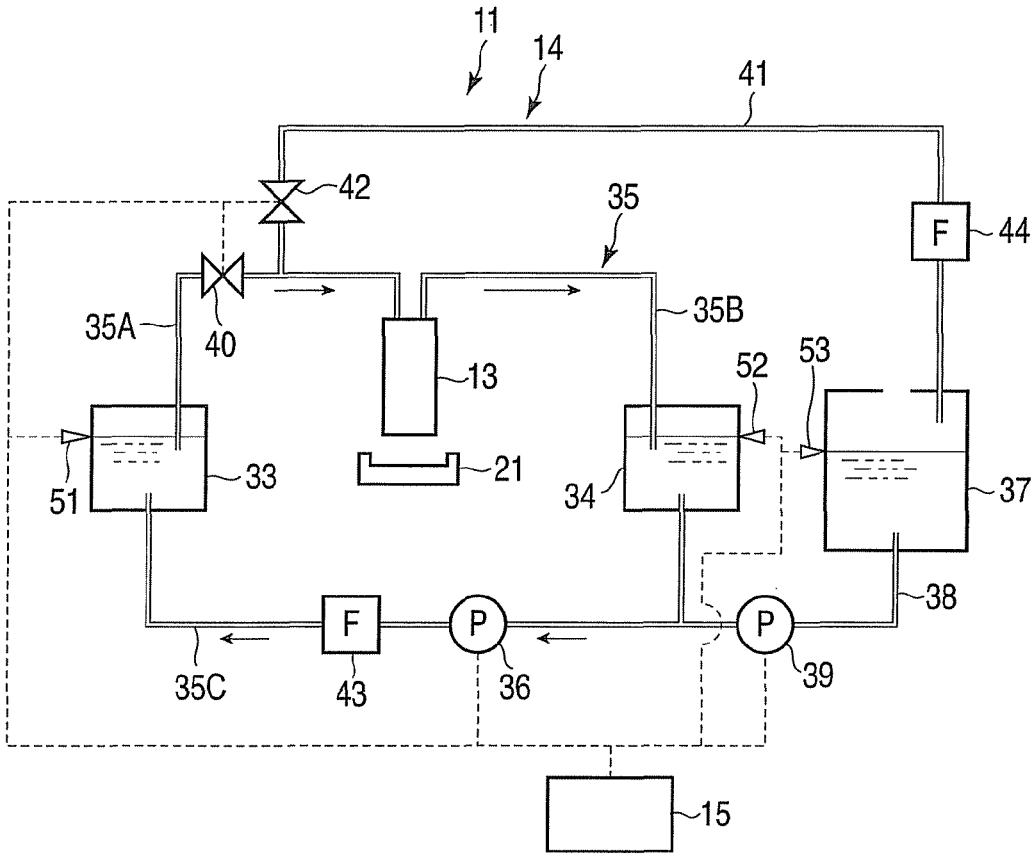
FIG. 2 is a system diagram showing a feed device of the inkjet recording apparatus shown in FIG. 1.
Figure 3:
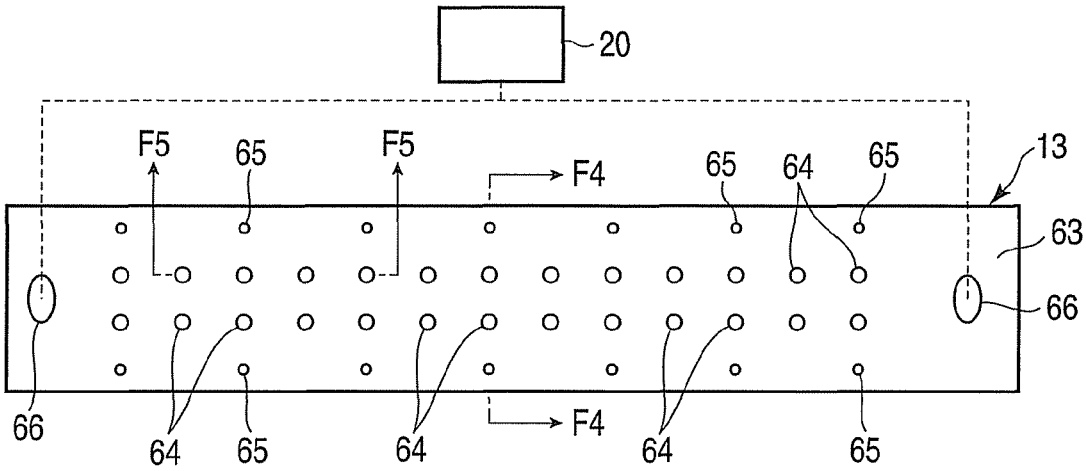
FIG. 3 is a bottom view showing the inkjet head shown in FIG. 1.

As shown in FIGS. 1 to 3, the inkjet recording apparatus 11 includes a main body case 12 serving as an outer hull of the apparatus. The inkjet recording apparatus 11 includes, inside the case 12, an inkjet head 13, a feed device 14 for supplying the inkjet head 13 with liquid, a control section 15 for controlling printing of the inkjet head 13, a sheet feed mechanism 16 for feeding the sheet-like recording medium 17, a paper feed cassette 18 in which the sheet-like recording medium 17 is contained, and a manual-bypass tray 19 provided independently of the paper feed cassette 18. The inkjet recording apparatus 11 further includes a maintenance device (not shown) for maintaining the inkjet head 13, a suction device 20 for drawing liquid from a second suction hole 66 (to be described later) of the inkjet head 13, and a tub-like head bath 21 in which the inkjet head 13 is dipped. The suction device 20 is constituted of, for example, a vacuum pump or the like which can draw liquid while removing the liquid.

As shown in FIG. 1, the sheet feed mechanism 16 includes a drum 25 which is provided rotatable, and around which the sheet-like recording medium 17 is wound, an electrification roller 26 for attracting the sheet-like recording medium 17 to the drum 25, a first feed roller 27 for sending the sheet-like recording medium 17 in the paper feed cassette 18 toward the drum 25, a second feed roller 28 for sending the sheet-like recording medium 17 inserted into the manual-bypass tray 19 toward the drum 25, and a switching mechanism 29 capable of switching between sheet feed by the first feed roller 27, and sheet feed by the second feed roller 28.

Although not shown, the maintenance device includes a wiping device provided with a blade for wiping up liquid adhering to the nozzle plate 63, a suction device for drawing a nozzle 64 to dissolve the nozzle clogging problem, and the like.

As shown in FIG. 2, the feed device 14 is constituted of so-called circulative elements. That is, the feed device 14 includes a first tank 33, a second tank 34, a circulation flow path 35, a first pump 36, a main tank 37, a feed flow path 38, a second pump 39, a first valve 40, a collection flow path 41, a second valve 42, a first filter device 43, and a second filter device 44. It should be noted that the tank mentioned in the present invention implies a concept including the first tank 33 and the second tank 34. Further, the circulation flow path 35 corresponds to the flow path mentioned in the present invention.

The main tank 37 is constituted of a tank opened to the atmosphere. Liquid is retained inside the main tank 37. The liquid is constituted of, for example, ink or the like capable of forming an image on the sheet-like recording medium 17. The main tank 37 can supply the liquid retained therein to the circulation flow path 35. The main tank 37 has a capacity greater than those of the first tank 33 and the second tank 34. The main tank 37 includes a third liquid level sensor 53. The third liquid level sensor 53 can sense a height of the liquid retained inside the main tank 37.

The first tank 33 is a so-called sub-tank, and retains liquid therein. The first tank 33 includes a first liquid level sensor 51. The first liquid level sensor 51 can sense a height of the liquid retained inside the first tank 33. The first tank 33 is placed on, for example, an upper side of a fixed stand (not shown). The first liquid level sensor 51 monitors the liquid level of the liquid in the first tank 33 in such a manner that the amount of liquid retained in the first tank 33 becomes greater than or equal to a predetermined liquid amount.

The second tank 34 is a so-called sub-tank, and retains liquid therein. The second tank 34 also includes a second liquid level sensor 52. The second liquid level sensor 52 can sense a height of the liquid retained inside the second tank 34. The second tank 34 is placed on an upper side of a height adjustment mechanism (not shown), and the installation height can be changed. The second liquid level sensor 52 monitors the liquid level of the liquid in the second tank 34 in such a manner that the amount of liquid retained in the second tank 34 becomes greater than or equal to a predetermined liquid amount.

The circulation flow path 35 includes a first part 35A for connecting the first tank 33, and the inkjet head 13 to each other, a second part 35B for connecting the inkjet head 13, and the second tank 34 to each other, and a third part 35C for connecting the second tank 34, and the first tank 33 to each other. In other words, the inkjet head 13, the first tank 33, and the second tank 34 are arranged independently of each other in the circulation flow path 35 formed into a loop. The feed flow path 38 connects the main tank 37, and the third part 35C to each other. The collection flow path 41 connects the first part 35A and the main tank 37 to each other at a position between the first valve 40 and the inkjet head 13.

The first pump 36 is provided in the middle of the third part 35C. As shown in FIG. 2, the first pump 36 can circulate the liquid in the circulation flow path 35 in the direction indicated by arrows →, i.e., in the direction of circulating in the order of the first part 35A, the second part 35B, and the third part 35C.

The second pump 39 is provided in the middle of the feed flow path 38. The second pump 39 can send liquid from the main tank 37 into the circulation flow path 35, and supply the liquid into the circulation flow path 35.

Each of the first valve 40 and the second valve 42 is constituted of an electromagnetic valve. The first valve 40 is provided in the middle of the first part 35A. The second valve 42 is provided in the middle of the collection flow path 41. Each of the first valve 40 and the second valve 42 can open or close the flow path by the control of the control section 15.

The feed flow path 38 connects the third part 35C of the circulation flow path 35, and the main tank 37 to each other. The collection flow path 41 connects the first part 35A of the ink circulation flow path 35, and the main tank 37 to each other. The collection flow path 41 is connected to the first part 35A at a position between the first valve 40 and the inkjet head 13.

The first filter device 43 is provided in the middle of the third part 35C at a position between the first tank 33 and the first pump 36. The first filter device 43 includes a mesh-like filter main body, a housing surrounding the filter main body, and the like. The second filter device 44 is provided in the middle of the collection flow path 41. The second filter device 44 includes a mesh-like filter main body, a housing surrounding the filter main body, and the like. Foreign matter contained in the liquid can be removed by the first and second filter devices 43 and 44.

The control section 15 monitors the liquid level of the liquid in the first tank 33 through the first liquid level sensor 51. When the liquid volume of the liquid in the first tank 33 becomes small, the control section 15 drives the first pump 36 and the second pump 39 to supply liquid from the main tank 37 to the first tank 33. Further, the control section 15 monitors the liquid level of the liquid in the second tank 34 through the second liquid level sensor 52. When the liquid volume of the liquid in the second tank 34 becomes small, the control section 15 drives the second pump 39 to supply liquid from the main tank 37 to the second tank 34.

Figure 4:
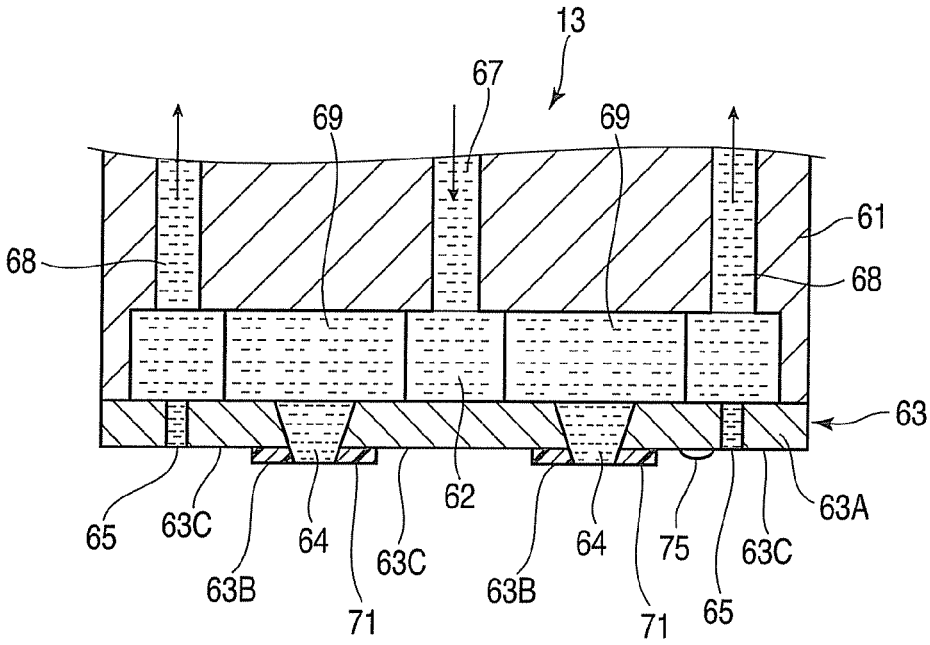
FIG. 4 is a cross-sectional view of the inkjet head shown in FIG. 3 taken along line F4-F4.
Figure 5:
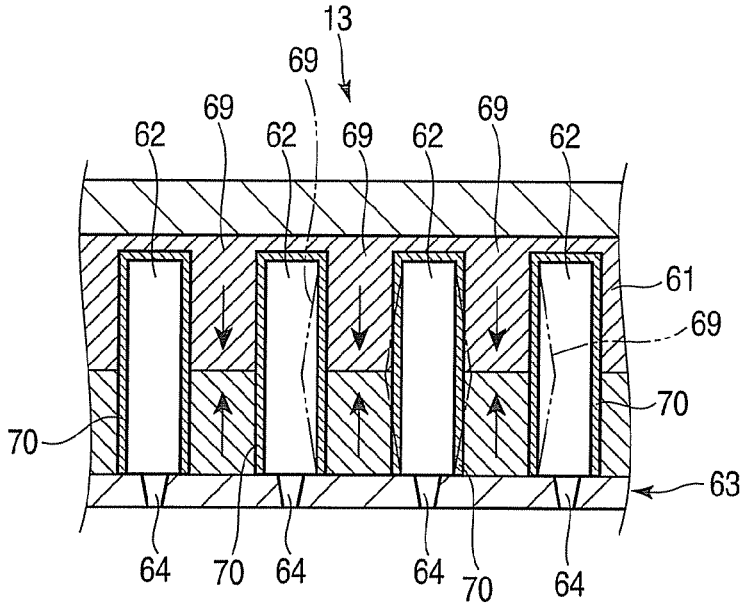
FIG. 5 is a cross-sectional view of the inkjet head shown in FIG. 3 taken along line F5-F5.

The inkjet head 13 is constituted of a so-called shear mode side-shooter type head. As shown in FIGS. 3 to 5, the inkjet head 13 includes a head main body 61, a plurality of liquid chambers 62 which are built in the head main body 61, and in which liquid is kept under negative pressure, a nozzle plate 63 bonded to the head main body 61 in such a manner that the plate 63 constitutes one wall part of each of the liquid chambers 62, a plurality of nozzles 64 and a plurality of first suction holes 65 formed in the nozzle plate 63 in such a manner that the nozzles 64 and holes 65 communicate with the liquid chambers 62, and a plurality of second suction holes 66 formed in the nozzle plate 63 independently of the liquid chambers 62.

As shown in FIG. 4, the inkjet head 13 further includes a feed section 67 built in the head main body 61, and connecting the liquid chambers 62 and the first part 35A of the circulation flow path 35 to each other, a discharge section 68 built in the head main body 61, and connecting the liquid chambers 62 and the second part 35B of the circulation flow path 35 to each other, and a driver IC (not shown) for driving ejection of liquid droplets.

As shown in FIG. 3, the plural nozzles 64 are formed to be juxtaposed in two rows in the central part of the nozzle plate 63. As shown in FIG. 4, the nozzle 64 has a trapezoidal cross-sectional shape.

It should be noted that the liquid level of the inkjet head 13 is at a position higher than the liquid level of the first tank 33 and the liquid level of the second tank 34. Accordingly, by virtue of the water head difference between the liquid level of the inkjet head 13 and those of the first tank 33 and the second tank 34, the liquid in the liquid chambers 62 is kept under the negative pressure. In this case, the pressure on the liquid in the liquid chambers 62 is controlled constant within a range of, for example, 0 to −3 kPa.

As shown in FIG. 5, the head main body 61 is formed by sticking together two plate-like piezoelectric members made of lead zirconate titanate (PZT). The piezoelectric members are stuck together in such a manner that their polarization directions are opposite to each other.

The liquid chamber 62 is a so-called pressure chamber, and corresponds to the nozzle 64. The inkjet head 13 includes a support 69 serving as a drive element between two liquid chambers 62. The support 69 is formed into one of a pair as two wall parts of the liquid chambers 62 so as to correspond to each nozzle 64, and can eject liquid droplets from the nozzle 64.

As shown in FIG. 4, the supports 69 are arranged in two rows to correspond to the nozzles 64 arranged in two rows. An electrode 70 for driving the support 69 is formed to extend from the side surface of the support 69 to the bottom surface of the liquid chamber 62.

As shown in FIG. 4, the nozzle plate 63 includes a plate main body 63A, liquid-repellent areas 63B formed on the plate main body 63A, and around the nozzles 64, and lyophilic areas 63C formed on the plate main body 63A, and around the first suction holes 65 and the second suction holes 66. The liquid-repellent area 63B is formed by covering the surface of the plate main body 63A with a liquid-repellent layer 71 having liquid repellency. The lyophilic area 63C is formed sunken with respect to the liquid-repellent area 63B. In this embodiment, the nozzle plate 63 is formed of, for example, polyimide. Further, the liquid-repellent layer 71 is formed of, for example, a fluororesin.

As shown in FIG. 4, the first suction hole 65 has a cylindrical cross-sectional shape. The first suction hole 65 communicates with the liquid chamber 62 near the discharge section 68. The diameter of the first suction hole 65 is made less than or equal to that of the nozzle 64.

As shown in FIG. 3, the second suction hole 66 is formed into an oval shape. The diameter of the second suction hole 66 is made greater than that of the nozzle 64. Further, the second suction hole 66 is formed independently of the liquid chamber 62 not to communicate with the liquid chamber 62. The second suction hole 66 is connected to the suction device 20 through a liquid discharge flow path formed inside the head main body 61 independently of the liquid chamber 62. In this embodiment, illustration of the liquid discharge flow path is omitted.

In the inkjet recording apparatus 11 configured as described above, ejection of liquid droplets is performed in the following manner. That is, the control section 15 outputs a print signal to the inkjet head 13, i.e., to the driver IC. On receiving the print signal, the driver IC applies a drive pulse voltage to the supports 69 through electrical wiring. As a result of this, the pair of supports (right and left) 69 effect shear mode deformation to bend and break away from each other as indicated by two-dot chain lines in FIG. 5. Further, the deformed supports are then restored to the initial positions, whereby the liquid in the liquid chamber is pressurized, and liquid droplets are ejected from the nozzle 64 vigorously.

On the other hand, when ejection of liquid droplets is repeated, mist is caused around the nozzle 64, and the mist adheres to the nozzle plate 63 to produce adhered liquid 75 as shown in FIG. 4. If the adhered liquid 75 is left as it is, the ejection direction of the liquid droplets ejected from the nozzle 64 is crooked or ejection failure is caused. In the inkjet head 13 of this embodiment, the adhered liquid 75 is gathered up from the liquid-repellant area 63B toward the lyophilic area 63C. The adhered liquid 75 gathered up at the lyophilic area 63C is drawn into the liquid chamber 62 kept under the negative pressure through the first suction hole 65. As a result of this, adhered liquid is continuously removed on the nozzle plate 63. Accordingly, in this embodiment, the number of maintenance operations such as wiping of the inkjet head 13 is extremely small as compared with an ordinary inkjet recording apparatus.

Subsequently, the manufacturing process of the nozzle 64, the first suction hole 65, the second suction hole 66, the lyophilic area 63C, and the liquid-repellent area 63B which are formed on the nozzle plate 63 will be described below.

In the inkjet head 13 of this embodiment, the head 13 is subjected to laser processing in a state where the nozzle plate 63 is bonded to the head main body 61, thereby collectively forming the nozzles 64, first suction holes 65, second suction holes 66, and lyophilic areas 63C. Further, a liquid-repellent layer 71 is uniformly formed in advance on the entire surface of the plate main body 63A. A laser beam is applied to the nozzle plate 63, and the lyophilic areas 63C are formed. The lyophilic areas 63C are formed by peeling off the liquid-repellent layer 71 by the laser beam, and exposing the surface of the plate main body 63A. On the other hand, the liquid-repellent areas 63B are formed at parts at which the liquid-repellent layer 71 is left unremoved, i.e., at parts at which the liquid-repellent layer 71 is not peeled off in the laser processing.

Further, the nozzles 64, the first suction holes 65, and the second suction holes 66 are formed by the laser processing. The nozzle 64 is formed in the center of the liquid-repellent area 63B. In this embodiment, in the laser processing, for example, an excimer laser is used. However, the laser used in the laser processing is not limited to this. Any type of laser may be used as long as the laser has a short wavelength. The type of laser that can be used in the laser processing is, for example, the YAG 4th harmonic laser, and the like.

It should be noted that, in this embodiment, although the second suction hole 66 is provided independently of the liquid chamber 62, the second suction hole may be connected to the liquid chamber 62 by interposing a filter between the second suction hole 66 and the liquid chamber 62. As a result of this, it is possible to reuse the liquid drawn from the suction hole 66 by returning the drawn liquid to the liquid chamber 62 while removing foreign matter by the filter. At this time, the foreign matter is not mixed in the liquid inside the liquid chamber 62, and the nozzle 64 is prevented from being clogged with the foreign matter.

The inkjet recording apparatus of this embodiment has been described above. According to this embodiment, the inkjet head 13 includes a head main body 61, liquid chambers 62 which are built in the head main body 61, and in which liquid is kept under negative pressure, a nozzle plate 63 bonded to the head main body 61 in such a manner that the plate 63 constitutes one wall part of each of the liquid chambers 62, nozzles 64 formed in the nozzle plate 63 in such a manner that the nozzles communicate with the liquid chambers 62, supports 69 serving as drive elements for ejecting liquid droplets from the nozzle 64, and first suction holes 65 formed in the nozzle plate 63 in such a manner that the holes 65 communicate with the liquid chambers 62.

According to this configuration, in the liquid chamber 62, the liquid is kept under the negative pressure, and hence when liquid adheres to the nozzle plate 63, the adhered liquid is drawn into the liquid chamber 62 from the first suction hole 65. As a result of this, by removing the liquid adhering to the nozzle plate 63, it is possible to prevent ejection failure caused by the adhered liquid from occurring, and prevent the ejection direction of the liquid droplets from being crooked. Further, liquid is routinely drawn from the first suction hole 65 as described above, and hence the number of times of execution of maintenance such as wiping on the inkjet head 13 can be reduced. As a result of this, the interval between maintenance operations is prolonged, and the printing speed can therefore be made higher. It should be noted that, although the adhered liquid 75 adhering to the nozzle plate 63 is returned to the liquid chamber 62, the ratio of the amount of the adhered liquid 75 to the amount of the liquid inside the liquid chamber 62 is small, and hence the influence of the adhered liquid 75 is extremely small. Further, the amount of liquid adhering to the nozzle plate 63 becomes small, and hence, the configuration of the wiping device or the like of the maintenance device can be made simple.

In this case, the diameter of the first suction hole 65 is less than or equal to that of the nozzle 64. According to this configuration, it is possible to prevent a foreign particle or the like having a size greater than the diameter of the nozzle 64 from being drawn into the liquid chamber 62. As a result of this, it is also possible to prevent the foreign particle from being trapped in the nozzle 64 to clog the nozzle 64.

In this case, the circulation flow path 35 includes the first part 35A for supplying liquid from the first tank 33 to the inkjet head 13, and the second part 35B for collecting liquid from the inkjet head 13 to the second tank 34, and the inkjet head 13 includes the feed section 67 built in the head main body 61, and connecting the liquid chambers 62 and the first part 35A to each other, and the discharge section 68 built in the head main body 61, and connecting the liquid chambers 62 and the second part 35B to each other.

According to this configuration, the circulation flow path 35 and the inkjet head 13 can be constituted of so-called circulative elements. As a result of this, it is possible to circulate liquid within the liquid chamber 62 of the inkjet head 13, and wash away foreign matter by the circulation flow of the liquid even when the foreign matter clogs the nozzle 64. As a result of this, ejection failure can be prevented from occurring to the utmost.

In this case, the first suction hole 65 communicates with the liquid chamber 62 near the discharge section 68. According to this configuration, the liquid drawn from the first suction hole 65 is caused to flow toward the second tank 34 through the discharge section 68. Thus, when the characteristic of the drawn liquid has been changed, it is possible to prevent the drawn liquid from flowing to the vicinity of the nozzle 64, and being ejected from the nozzle 64 as it is as liquid droplets.

In this case, the inkjet head 13 includes the second suction hole 66, and the second suction hole 66 is formed in the nozzle plate 63 independently of the liquid chamber 62, and draws extraneous matter adhering to the nozzle plate 63.

According to this configuration, by providing the second suction hole 66 which does not communicate with the liquid chamber 62, it is possible to draw extraneous matter on the nozzle plate 63.

In this case, the inkjet recording apparatus 11 further includes the suction device 20 for drawing the extraneous matter through the second suction hole 66. According to this configuration, it is possible to efficiently draw foreign matter captured from the second suction hole 66.

In this case, the diameter of the second suction hole 66 is made greater than that of the nozzle 64. According to this configuration, it is possible to draw foreign matter having a size that cannot be drawn by the first suction hole 65 by the second suction hole 66. As a result of this, it is possible to draw adhered liquid 75 and foreign matter adhering to the nozzle plate 63 more efficiently. In this case, the second suction hole 66 is independent of the liquid chamber 62, and hence the foreign matter drawn from the second suction hole 66 is neither taken into the liquid chamber 62 nor trapped in the nozzle 64.

In this case, the nozzle plate 63 includes the liquid-repellent areas 63B formed around the nozzles 64, and the lyophilic areas 63C formed around the first suction holes 65 and the second suction holes 66. According to this configuration, it is possible to prevent mist adhering to the nozzle plate 63 from growing to liquid droplets (adhered liquid 75). Further, according to this configuration, it is possible to gather the liquid droplets resulting from the mist to the lyophilic areas 63C around the first suction holes 65 and the second suction holes 66. As a result of this, the suction efficiency of the adhered liquid 75 can be improved.

In this case, the liquid-repellent area 63B is formed by covering the entire surface of the nozzle plate 63 with the liquid-repellent layer 71, and the lyophilic area 63C is formed by peeling off a part of the liquid-repellent layer by laser processing. According to this configuration, it is possible to produce the liquid-repellent area 63B and the lyophilic area 63C by a simple manufacturing process.

In this case, the lyophilic area 63C is formed sunken with respect to the liquid-repellent area 63B. According to this configuration, it is possible to gather the liquid adhering to the nozzle plate 63 to the lyophilic area 63C further more efficiently.

In this case, the first suction hole 65, the second suction hole 66, and the liquid-repellent area 63B are collectively formed by laser processing. According to this configuration, these holes and area can be formed easily in a shorter time than when they are formed individually. Particularly, the first suction hole 65 and the second suction hole 66 are each formed in the lyophilic area 63C, and hence it is possible to manufacture the inkjet head 13 more efficiently in the above manner.

Figure 6:
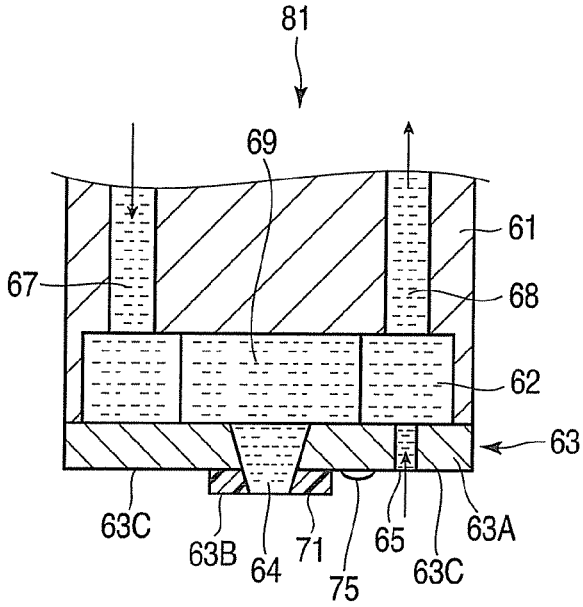
FIG. 6 is a cross-sectional view showing an inkjet head of an inkjet recording apparatus according to a second embodiment.

Subsequently, a second embodiment of an inkjet recording apparatus 11 will be described below with reference to FIG. 6. The inkjet recording apparatus 11 of the second embodiment differs from the first embodiment in the arrangement of a nozzle 64 of an inkjet head 81, and in the arrangement of a support 69 serving as a drive element. Thus, parts different from the first embodiment will be mainly described, parts common to the first embodiment will be denoted by the common reference symbols, and a description of them will be omitted.

The inkjet head 81 of the inkjet recording apparatus 11 according to the second embodiment is also of the circulation type as in the case of the first embodiment. In the inkjet head 81, a plurality of nozzles 64 are formed in a nozzle plate 63 to be arranged in an array. Supports 69 serving as drive elements are formed in a pair at wall parts on both sides of liquid chambers 62, to correspond to the above configuration. A first suction hole 65 communicates with the liquid chamber near a discharge section 68. Further, although not shown, a second suction hole 66 does not communicate with the liquid chamber 62, and is formed in the nozzle plate 63 independently of the liquid chamber 62. It should be noted that, in FIG. 6, only one nozzle 64 and only one support 69 are shown.

The function of the inkjet head 81 will be described below. Liquid is supplied to the inkjet head 81 from a first tank 33. The liquid is supplied to the liquid chamber 62 through a feed section 67, a part of the liquid is ejected from the nozzle 64 as liquid droplets, and a part of the liquid is sent to a second tank 34 through the discharge section 68. At this time, the inside of the liquid chamber 62 is kept under negative pressure, and hence adhered liquid 75 adhering to the nozzle plate 63 is drawn into the liquid chamber 62 through the first suction hole 65, and is sent toward the discharge section 68. However, the mount of the drawn liquid is a very small amount as compared with the amount of the liquid circulated in the feed device 14 and the inkjet head 81, and thus the influence thereof can be neglected. Further, at the second suction hole 66, too, foreign matter on the nozzle plate 63 is drawn therein, and the foreign matter is drawn into a suction device 20.

According to the second embodiment, even in the case where the nozzles are arranged in one line, it is possible, by providing the first suction hole 65, to draw the adhered liquid 75 adhering to the nozzle plate 63 from the first suction hole 65. Further, since the first suction hole 65 communicates with the liquid chamber 62 near the discharge section 68, it is possible to prevent the adhered liquid 75 drawn from the first suction hole 65 from being ejected from the nozzle 64 as it is.

Figure 7:
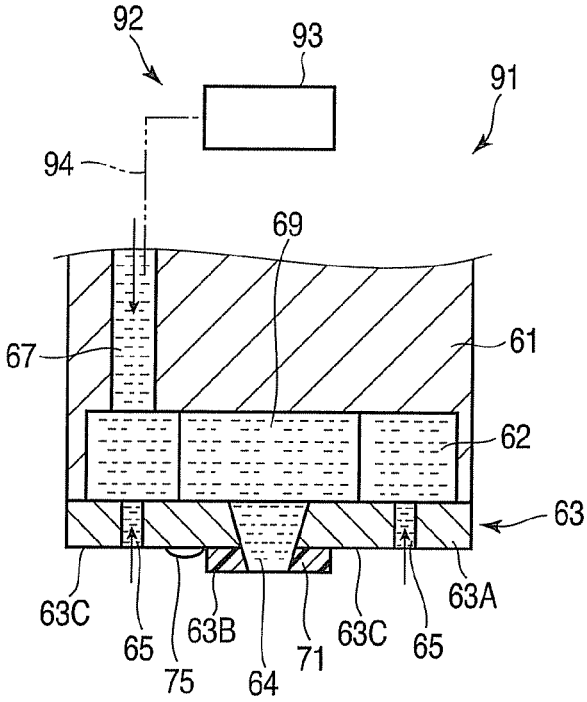
FIG. 7 is a cross-sectional view showing an inkjet head of an inkjet recording apparatus according to a third embodiment.
Figure 8:
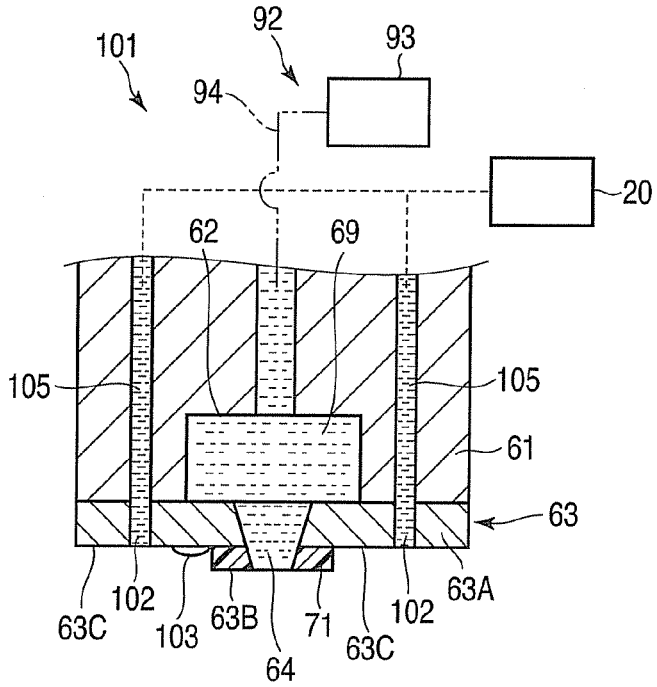
FIG. 8 is a cross-sectional view showing an inkjet head of an inkjet recording apparatus according to a fourth embodiment.

Subsequently, a third embodiment of an inkjet recording apparatus 11 will be described below with reference to FIG. 7. The inkjet recording apparatus 11 of the third embodiment differs from that of the first embodiment in the structure of an inkjet head 91 and the structure of a feed device 92. Accordingly, parts different from the first embodiment will be mainly described, parts common to the first embodiment will be denoted by the common reference symbols, and a description of them will be omitted.

The feed device 92 is constituted of so-called non-circulative elements. That is, the feed device 92 includes a tank 93, and a connection flow path 94 for connecting the tank 93 and the inkjet head 91 to each other.

The inkjet head 91 is that of the non-circulative type. The inkjet head 91 includes a head main body 61, a plurality of liquid chambers 62 which are built in the head main body 61, and in which liquid is kept under negative pressure, a nozzle plate 63 bonded to the head main body 61 in such a manner that the plate 63 constitutes one wall part of each of the liquid chambers 62, a plurality of nozzles 64 formed in the nozzle plate 63 in such a manner that the nozzles 64 communicate with the liquid chambers 62, first suction holes 65 formed in the nozzle plate 63 in such a manner that the nozzles 64 communicate with the liquid chambers 62, and second suction holes 66 formed in the nozzle plate 63 independently of the liquid chambers 62.

The inkjet head 91 further includes a feed section 67 built in the head main body 61, and the feed section 67 connects the liquid chambers 62 and the connection flow path 94 to each other. It should be noted that, in FIG. 7, although illustration of the second suction hole is omitted, the second suction hole does not communicate with liquid chamber 62, and is formed in the nozzle plate 63 independently of the liquid chamber 62.

In the third embodiment, the nozzles 64 are formed in one line. To correspond to this, supports 69 serving as drive elements are formed in a pair at wall parts on both sides of the liquid chamber 62. Further, first suction holes 65 are formed in a pair on both sides of the nozzle 64. In FIG. 7, only one nozzle 64 and only one support 69 are shown.

It should be noted that the inkjet head 91 is arranged at a position higher than, for example, the tank 93, and a predetermined water head difference is provided between the liquid level of the tank 93 and the nozzle surface of the inkjet head 91. As a result of this, the inside of the liquid chamber 62 of the inkjet head 91 is held under negative pressure.

The function of the inkjet head 91 according to the third embodiment will be described below. As shown in FIG. 7, liquid is supplied to the inkjet head 91 from the tank 93 through the connection flow path 94. The liquid is supplied to the liquid chamber 62 through the feed section 67. At this time, the inside of the liquid chamber 62 is held under the negative pressure, and hence the adhered liquid 75 and foreign matter adhering to the nozzle plate 63 is drawn into the liquid chamber 62 through the first suction hole 65. However, the diameter of the first suction hole 65 is made less than that of the nozzle 64, and thus the nozzle 64 is prevented from being clogged with the foreign matter drawn into the liquid chamber 62.

According to the third embodiment, even when the inkjet head 91 is of the non-circulative type, it is possible, by providing the first suction hole 65, to draw adhered liquid 75 from the first suction hole 65.

Subsequently, a fourth embodiment of an inkjet recording apparatus 11 will be described below with reference to FIGS. 8 to 11. The inkjet recording apparatus 11 of the fourth embodiment differs from the first to third embodiments in the structure of an inkjet head 101. Accordingly, parts different from those of the first to third embodiments will be mainly described, parts common to the first to third embodiments are denoted by the common reference symbols, and a description of them will be omitted.

The inkjet recording apparatus 11 includes, inside a main body case 12, an inkjet head 101, a feed device 92 for supplying the inkjet head 101 with liquid, a control section 15 for controlling printing of the inkjet head 101, a sheet feed mechanism 16 for feeding a sheet-like recording medium 17, a paper feed cassette 18 in which the sheet-like recording medium 17 is contained, and a manual-bypass tray 19 provided independently of the paper feed cassette 18. The inkjet recording apparatus 11 further includes a maintenance device (not shown) for maintaining the inkjet head 101, a suction device 20 for drawing extraneous matter such as liquid or the like from a suction hole 102 (to be described later) of the inkjet head 101, and a tub-like head bath 21 in which the inkjet head 101 is dipped.

The feed device 92 is of the non-circulative type, and includes a tank 93, and a connection flow path 94 for connecting the tank 93 and the inkjet head 101 to each other.

The inkjet head 101 includes a head main body 61, a plurality of liquid chambers 62 which are built in the head main body 61, and in which liquid is retained, a nozzle plate 63 bonded to the head main body 61 in such a manner that the plate 63 constitutes one wall part of each of the liquid chambers 62, a plurality of nozzles 64 formed in the nozzle plate 63 in such a manner that the nozzles 64 communicate with the liquid chambers 62, and suction holes 102 formed in the nozzle plate 63 independently of the liquid chambers 62.

The plural nozzles 64 are formed to be juxtaposed in one line in the central part of the nozzle plate 63.

The suction hole 102 is formed not to communicate with the liquid chamber 62, i.e., independently of the liquid chamber 62. The suction hole 102 is connected to the suction device 20 through a liquid discharge flow path 105 formed inside the head main body 61 independently of the liquid chamber 62. The inkjet head 101 includes a support 69 serving as a drive element between two adjacent liquid chambers 62. It should be noted that, in FIGS. 8 to 11, only one nozzle 64 and only one support 69 are shown.

The function of the inkjet head 101 according to the fourth embodiment will be described below. Liquid is supplied from the tank 93 to the inkjet head 101 through the connection flow path 94. The liquid is supplied to the liquid chamber 62 through a feed section 67. When the support 69 is driven, liquid droplets are ejected from the nozzle 64. At this time, liquid adhering to the nozzle plate 63 is drawn into the suction device 20 through the suction hole 102. Accordingly, the surface of the nozzle plate 63 is kept clean to a certain degree.

Subsequently, the head maintenance method used in the inkjet head 101 according to the fourth embodiment will be described below. By this head maintenance method, it is possible, when extraneous matter 103 that cannot be removed even by the suction from the suction hole 102 adheres to the nozzle plate 63, to remove the extraneous matter 103.

Figure 9:
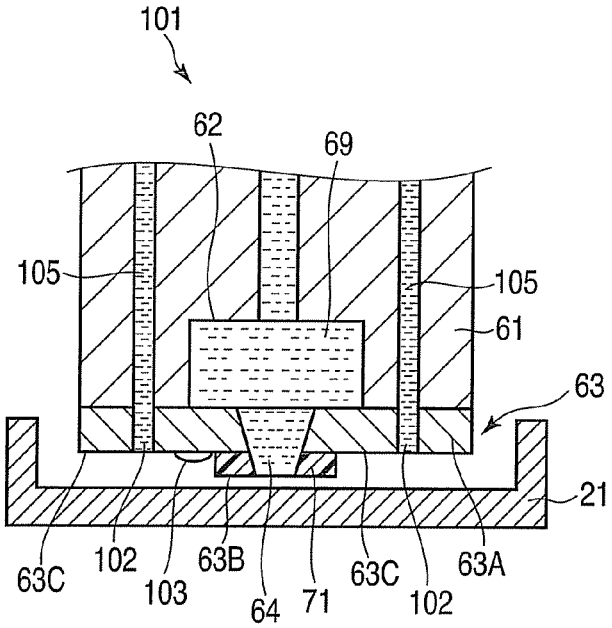
FIG. 9 is a cross-sectional view showing a first step of a head maintenance method in the inkjet head shown in FIG. 8.
Figure 10:
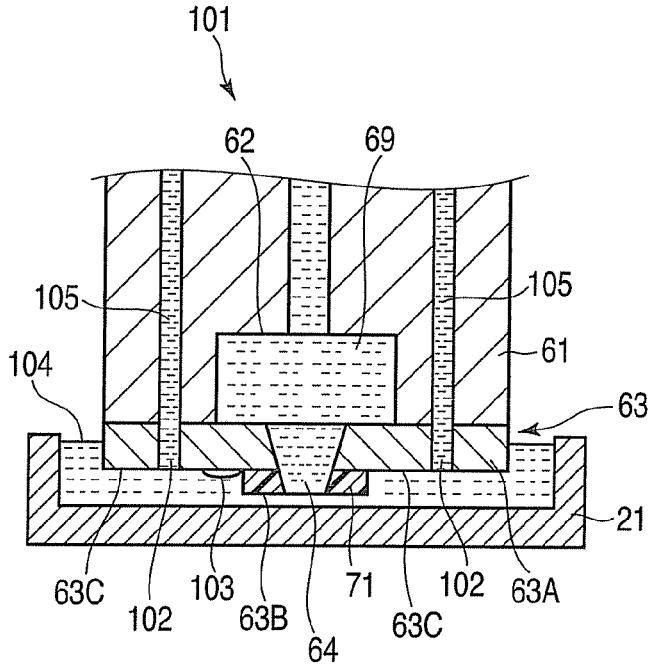
FIG. 10 is a cross-sectional view showing a second step subsequent to the first step shown in FIG. 9.
Figure 11:
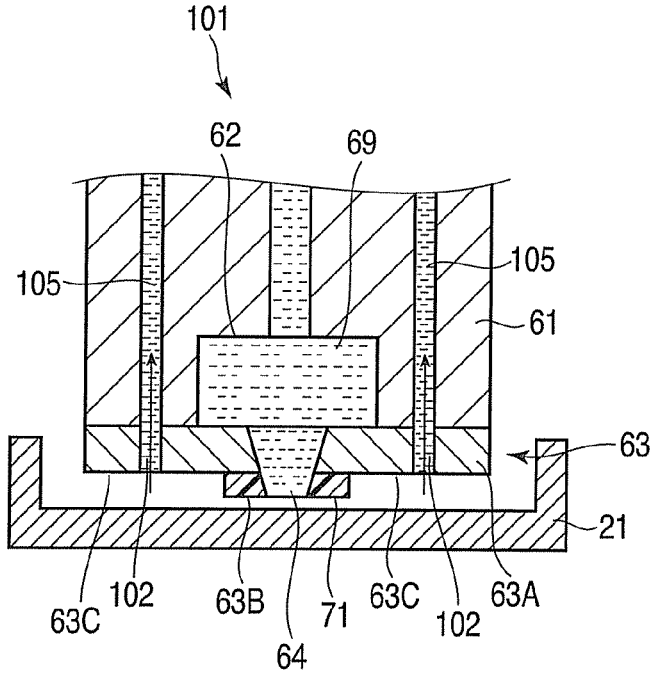
FIG. 11 is a cross-sectional view showing a third step subsequent to the second step shown in FIG. 10.

As shown in FIG. 9, for example, the head bath 21 is moved in such a manner that the inkjet head 101 is fitted in the head bath 21 with play. As shown in FIG. 10, the nozzle 64 is caused to eject liquid, and a liquid puddle 104 is formed in the head bath 21. When the liquid puddle 104 is formed, the nozzle plate 63 of the inkjet head 101 is dipped in the liquid puddle 104. After this, the suction device 20 is driven to draw the liquid and extraneous matter 103 from the suction hole 102. As a result of this, the surface of the nozzle plate 63 is washed, and the extraneous matter 103 is drawn in together with the liquid.

According to the inkjet head 101 and the head maintenance method of the fourth embodiment, it is possible, when there is extraneous matter 103 that cannot be removed by the normal suction from the suction hole 102, to wash away the extraneous matter 103 together with the liquid by forming a liquid puddle 104 in the head bath 21, and drawing the liquid. As a result of this, it is possible to impart the maintenance function to the inkjet head 101. Thus, the wiping device and the like included in the maintenance device can be constituted of a more simplified member as compared with the first embodiment.

It should be noted that the inkjet head 101 according to the fourth embodiment is constituted of non-circulative elements. However, even in the inkjet head of the circulative type, the structure of this embodiment can be employed.

A fifth embodiment of the present invention will be described below with reference to the accompanying drawings. An inkjet recording apparatus according to the fifth embodiment ejects liquid droplets toward a sheet-like recording medium such as paper to print characters or images on the recording medium.

Figure 12:
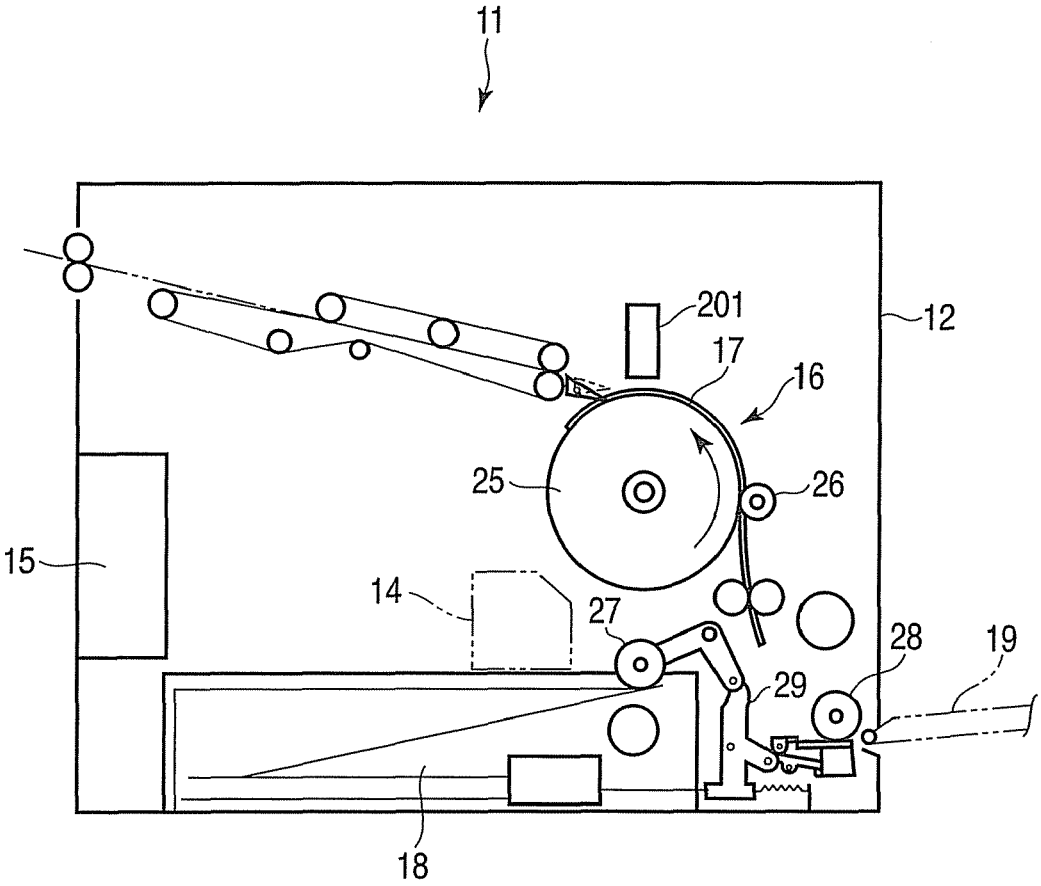
FIG. 12 is a schematic side view showing an inkjet recording apparatus according to a fifth embodiment.
Figure 13:
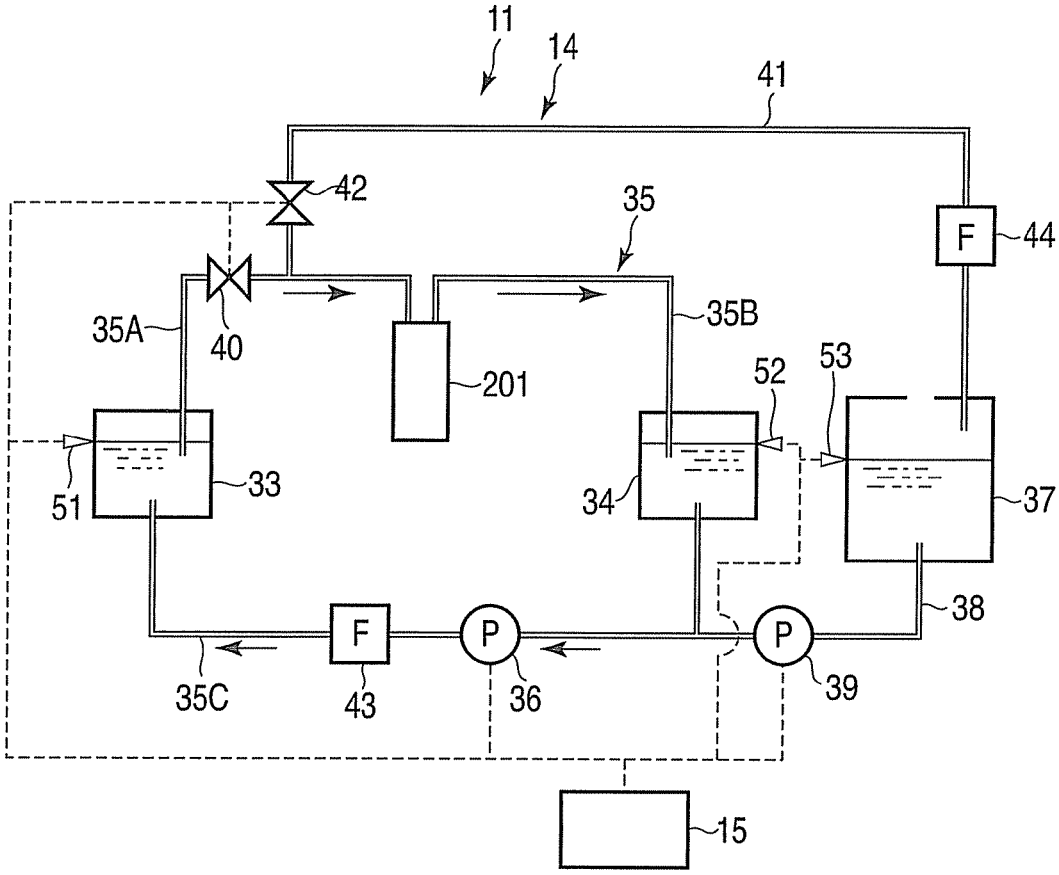
FIG. 13 is a system diagram showing a feed device of the inkjet recording apparatus shown in FIG. 12.
Figure 14:
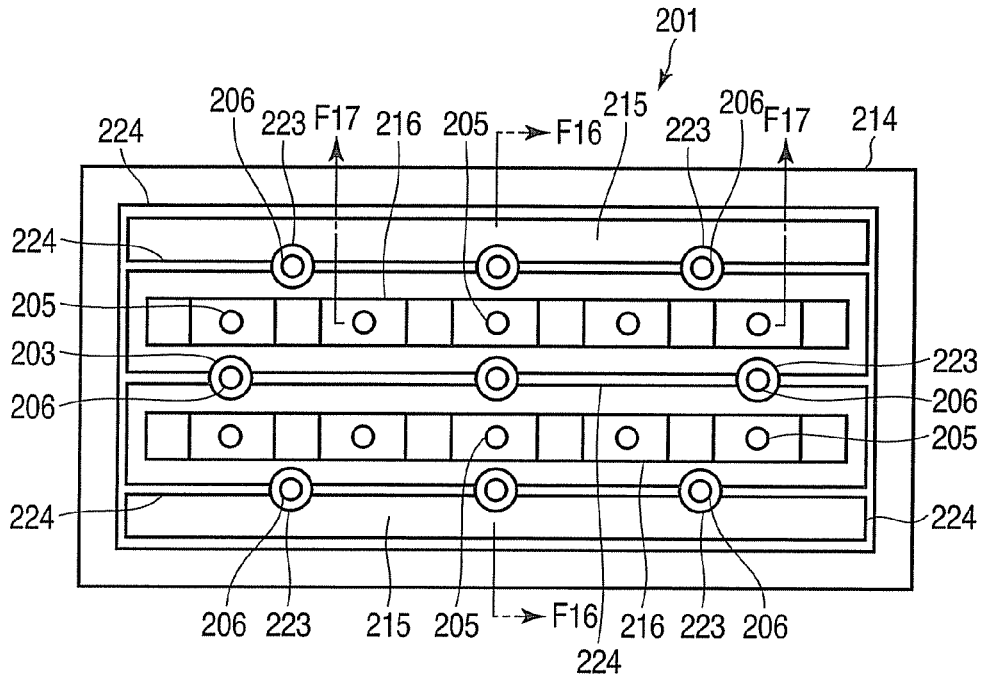
FIG. 14 is a bottom view showing the inkjet head shown in FIG. 13.

As shown in FIGS. 12 to 14, the inkjet recording apparatus 11 includes a main body case 12 serving as an outer hull of the apparatus. The inkjet recording apparatus 11 includes, inside the main body case 12, an inkjet head 201, a feed device 14 for supplying the inkjet head 201 with liquid, a control section 15 for controlling printing of the inkjet head 201, a sheet feed mechanism 16 for feeding the sheet-like recording medium 17, a paper feed cassette 18 in which the sheet-like recording medium 17 is contained, and a manual-bypass tray 19 provided independently of the paper feed cassette 18. The inkjet recording apparatus 11 further includes a maintenance device (not shown) for maintaining the inkjet head 201.

As shown in FIG. 12, the sheet feed mechanism 16 includes a drum 25 which is provided rotatable, and around which the sheet-like recording medium 17 is wound, an electrification roller 26 for attracting the sheet-like recording medium 17 to the drum 25, a first feed roller 27 for sending the sheet-like recording medium 17 in the paper feed cassette 18 toward the drum 25, a second feed roller 28 for sending the sheet-like recording medium 17 inserted into the manual-bypass tray 19 toward the drum 25, and a switching mechanism 29 capable of switching between sheet feed by the first feed roller 27, and sheet feed by the second feed roller 28.

Although not shown, the maintenance device includes a wiping device provided with a blade for wiping up liquid adhering to the nozzle plate 63, a suction device for drawing a nozzle 64 to dissolve the nozzle clogging problem, and the like.

As shown in FIG. 13, the feed device 14 is constituted of so-called circulative elements. That is, the feed device 14 includes a first tank 33, a second tank 34, a circulation flow path 35, a first pump 36, a main tank 37, a feed flow path 38, a second pump 39, a first valve 40, a collection flow path 41, a second valve 42, a first filter device 43, and a second filter device 44. It should be noted that the tank mentioned in the present invention implies a concept including the first tank 33 and the second tank 34. Further, the circulation flow path 35 corresponds to the flow path mentioned in the present invention.

The main tank 37 is constituted of a tank opened to the atmosphere. Liquid is retained inside the main tank 37. The liquid is constituted of, for example, ink or the like capable of forming an image on the sheet-like recording medium 17. The main tank 37 can supply the liquid retained therein to the circulation flow path 35. The main tank 37 has a capacity greater than those of the first tank 33 and the second tank 34. The main tank 37 includes a third liquid level sensor 53. The third liquid level sensor 53 can sense a height of the liquid retained inside the main tank 37.

The first tank 33 is a so-called sub-tank, and retains liquid therein. The first tank 33 includes a first liquid level sensor 51. The first liquid level sensor 51 can sense a height of the liquid retained inside the first tank 33. The first tank 33 is placed on, for example, an upper side of a fixed stand (not shown). The first liquid level sensor 51 monitors the liquid level of the liquid in the first tank 33 in such a manner that the amount of liquid retained in the first tank 33 becomes greater than or equal to a predetermined liquid amount.

The second tank 34 is a so-called sub-tank, and retains liquid therein. The second tank 34 also includes a second liquid level sensor 52. The second liquid level sensor 52 can sense a height of the liquid retained inside the second tank 34. The second tank 34 is placed on an upper side of a height adjustment mechanism (not shown), and the installation height can be changed. The second liquid level sensor 52 monitors the liquid level of the liquid in the second tank 34 in such a manner that the amount of liquid retained in the second tank 34 becomes greater than or equal to a predetermined liquid amount.

The circulation flow path 35 includes a first part 35A for connecting the first tank 33, and the inkjet head 201 to each other, a second part 35B for connecting the inkjet head 201, and the second tank 34 to each other, and a third part 35C for connecting the second tank 34, and the first tank 33 to each other. In other words, the inkjet head 201, the first tank 33, and the second tank 34 are arranged independently of each other in the circulation flow path 35 formed into a loop. The feed flow path 38 connects the main tank 37, and the third part 35C to each other. The collection flow path 41 connects the first part 35A and the main tank 37 to each other at a position between the first valve 40 and the inkjet head 201.

The first pump 36 is provided in the middle of the third part 35C. As shown in FIG. 13, the first pump 36 can circulate the liquid in the circulation flow path 35 in the direction indicated by arrows →, i.e., in the direction of circulating in the order of the first part 35A, the second part 35B, and the third part 35C.

The second pump 39 is provided in the middle of the feed flow path 38. The second pump 39 can send liquid from the main tank 37 into the circulation flow path 35, and supply the liquid into the circulation flow path 35.

Each of the first valve 40 and the second valve 42 is constituted of an electromagnetic valve. The first valve 40 is provided in the middle of the first part 35A. The second valve 42 is provided in the middle of the collection flow path 41. Each of the first valve 40 and the second valve 42 can open or close the flow path by the control of the control section 15.

The feed flow path 38 connects the third part 35C of the circulation flow path 35, and the main tank 37 to each other. The collection flow path 41 connects the first part 35A of the ink circulation flow path 35, and the main tank 37 to each other. The collection flow path 41 is connected to the first part 35A at a position between the first valve 40 and the inkjet head 201.

The first filter device 43 is provided in the middle of the third part 35C at a position between the first tank 33 and the first pump 36. The first filter device 43 includes a mesh-like filter main body, a housing surrounding the filter main body, and the like. The second filter device 44 is provided in the middle of the collection flow path 41. The second filter device 44 includes a mesh-like filter main body, a housing surrounding the filter main body, and the like. Foreign matter contained in the liquid can be removed by the first and second filter devices 43 and 44.

The control section 15 monitors the liquid level of the liquid in the first tank 33 through the first liquid level sensor 51. When the liquid volume of the liquid in the first tank 33 becomes small, the control section 15 drives the first pump 36 and the second pump 39 to supply liquid from the main tank 37 to the first tank 33. Further, the control section 15 monitors the liquid level of the liquid in the second tank 34 through the second liquid level sensor 52. When the liquid volume of the liquid in the second tank 34 becomes small, the control section 15 drives the second pump 39 to supply liquid from the main tank 37 to the second tank 34.

Figure 15:
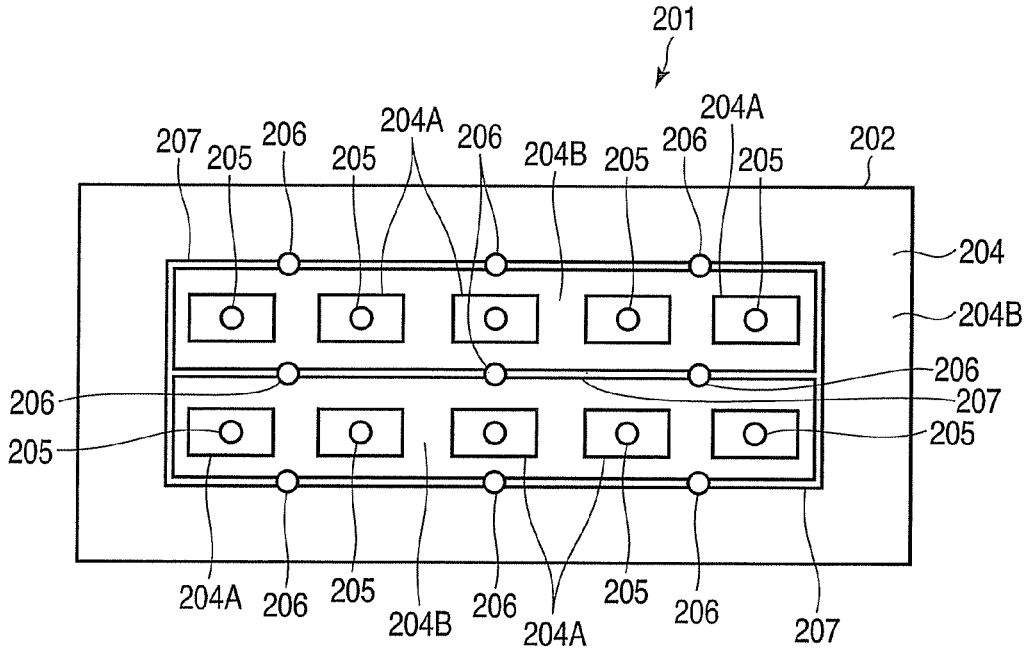
FIG. 15 is a bottom view showing the inkjet head shown in FIG. 14 in a state where a protective cover is removed.
Figure 16:
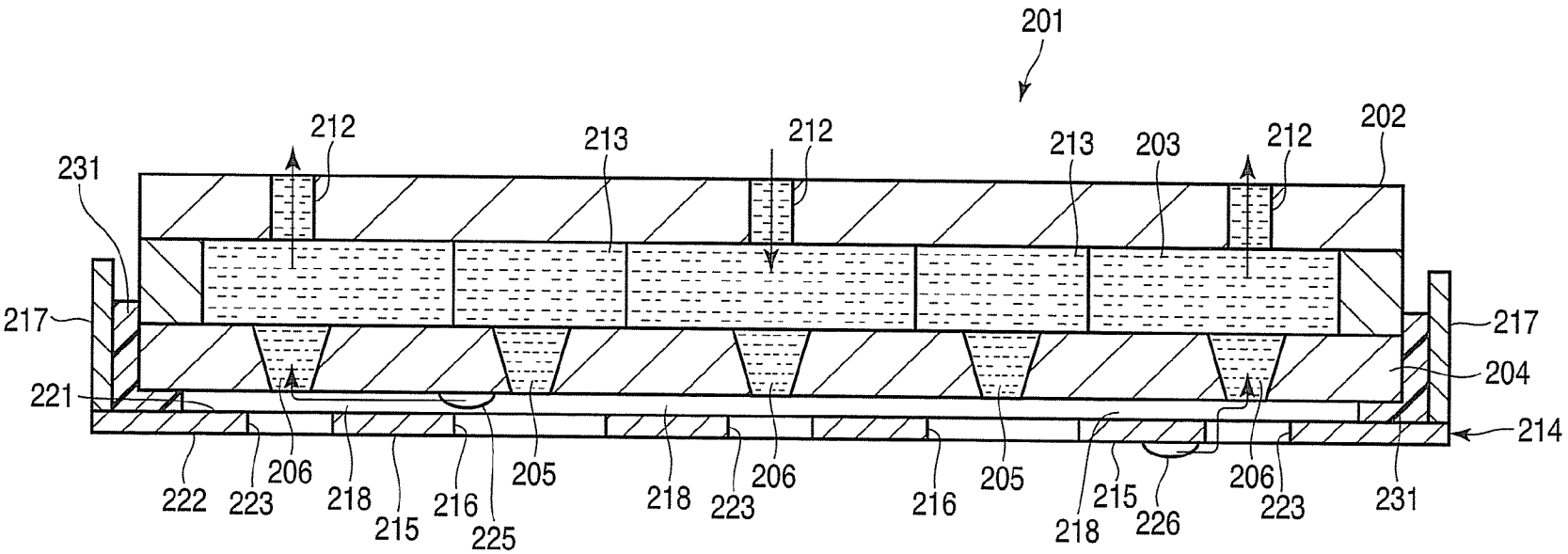
FIG. 16 is a cross-sectional view of the inkjet head shown in FIG. 14 taken along line F16-F16.

The inkjet head 201 is constituted of a so-called shear mode side-shooter type head. Liquid can circulate inside the inkjet head 201. As shown in FIGS. 14 to 16, the inkjet head 201 includes a head main body 202, a plurality of liquid chambers 203 which are built in the head main body 202, and in which liquid is kept under negative pressure, a nozzle plate 204 bonded to the head main body 202 in such a manner that the plate 204 constitutes one wall part of each of the liquid chambers 203, a plurality of nozzles 205 and a plurality of first liquid collection holes 206 formed in the nozzle plate 204 in such a manner that the nozzles 205 and holes 206 communicate with the liquid chambers 203. The diameter of the nozzle 205 is, for example, about 30 μm. Further, the diameter of the first liquid collection hole 206 is also, for example, about 30 μm.

The nozzle plate 204 is formed of, for example, polyimide, and is formed into a rectangular plate-like shape. The nozzle plate 204 includes liquid-repellent areas 204A formed around the nozzles 205, a lyophilic area 204B formed around the liquid-repellent areas 204A, and a first groove section 207 provided in the lyophilic area 204B. The lyophilic area 204B is subjected to surface property modification, and hence the affinity between the nozzle plate 204 and ink is enhanced. The first liquid collection hole 206 is provided in the lyophilic area 204B. The liquid-repellent area 204A is provided around the nozzle 205 in a rectangular shape. The liquid-repellent area 204A is not subjected to the surface treatment. It should be noted that the nozzle plate 204 may be formed of a metallic plate. In this case, the nozzles 205, the first liquid collection holes 206, and the first groove section 207 to be described later are collectively formed by subjecting the metallic nozzle plate 204 to press work.

The first groove section 207 is provided in the lyophilic area 204B to surround the liquid-repellent areas 204A in a lattice-like form. The first groove section 207 is formed depressed with respect to the surface of the lyophilic area 204B of the nozzle plate 204. The first groove section 207 is formed to be provided with a width of such a degree that the section 207 causes a capillary phenomenon with respect to the ink adhering to the surface of the lyophilic area 204B. More specifically, the first groove section 207 is so formed as to allow it to have a groove width of, for example, 30 to 50 μm, and a depth of 5 to 20 μm.

As shown in FIG. 15, the inkjet head 201 further includes a feed section 211 built in the head main body 202, and connecting the liquid chambers 203 and the first part 35A of the circulation flow path 35 to each other, a discharge section 212 built in the head main body 202, and connecting the liquid chambers 203 and the second part 35B of the circulation flow path 35 to each other, and a driver IC (not shown) for driving ejection of liquid droplets.

As shown in FIG. 15, the plural nozzles 205 are formed to be juxtaposed in two rows in the central part of the nozzle plate 204. As shown in FIG. 16, the nozzle 205 has a trapezoidal cross-sectional shape.

It should be noted that the liquid level of the inkjet head 201 is at a position higher than the liquid level of the first tank 33 and the liquid level of the second tank 34. Accordingly, by virtue of the water head difference between the liquid level of the inkjet head 201 and those of the first tank 33 and the second tank 34, the liquid in the liquid chambers 203 is kept under the negative pressure. In this case, the pressure on the liquid in the liquid chambers 203 is controlled constant within a range of, for example, 0 to −3 kPa.

As shown in FIG. 16, the head main body 202 is formed by sticking together two plate-like piezoelectric members made of lead zirconate titanate (PZT). The piezoelectric members are stuck together in such a manner that their polarization directions are opposite to each other.

The liquid chambers 203 are so-called pressure chambers, and correspond to the nozzles 205 on a one-to-one basis. The inkjet head 201 includes a support 213 serving as a drive element between two liquid chambers 203. The support 213 is formed into one of a pair as two wall parts of the liquid chambers 203 so as to correspond to each nozzle 205, and can eject liquid droplets from the nozzle 205. As shown in FIG. 15, the supports 213 are arranged in two rows to correspond to the nozzles 205 arranged in two rows. An electrode 219 for driving the support 213 is formed to extend from the side surface of the support 213 to the bottom surface of the liquid chamber 203.

As shown in FIG. 15, the first liquid collection hole 206 communicates with the liquid chamber 203 near the feed section 211 or the discharge section 212.

The inkjet head 201 further includes a protective cover 214 for protecting the nozzles 205 on the nozzle plate 204. The protective cover 214 is formed of a metallic material. The protective cover 214 prevents the nozzles 205 from being hurt by the paper or the like coming into contact with the nozzle plate 204 at the time of printing. The protective cover 214 includes a duplication section 215 for covering the surface of the nozzle plate 204, opening sections 216 provided at positions corresponding to the nozzles 205, and a frame section 217 provided on the periphery of the duplication section 215. The protective cover 214 is bonded to the head main body 202 through the frame section 217. A gap 218 is provided between the duplication section 215 and the nozzle plate 204, and the gap is formed into such a dimension as to allow the gap to exert capillary action strong enough to draw up the liquid toward the first liquid collection hole 206, for example, a dimension of about 0.01 to 0.1 mm. An adhesive 231 made of a resin for fixing the protective cover 214 is interposed between the frame section 217 and the head main body 202.

The duplication section 215 of the protective cover 214 includes a first surface 221 opposed to the nozzle plate 204, a second surface 222 on the opposite side of the first surface 221, second liquid collection holes 223 penetrating the first surface 221 and the second surface 222, and a second groove section 224 provided in the second surface 222 to surround the opening sections 216 in a lattice-like form. The second liquid collection hole 223 is arranged at a position corresponding to the first liquid collection hole 206. The diameter of the second liquid collection hole 223 is equivalent to that of the first liquid collection hole 206 or slightly greater than that of the first liquid collection hole 206.

The second groove section 224 is formed to be provided with a width of such a degree that the section 224 causes a capillary phenomenon with respect to the ink adhering to the surface of the lyophilic area 204B. More specifically, the second groove section 224 is so formed as to allow it to have a groove width of, for example, about 100 μm, and a depth of about 50 μm. The second liquid collection hole 223 and the second groove section 224 are collectively formed by a method of subjecting the flat plate-like duplication section 215 to micromachining such as press work, etching, and laser processing.

Figure 17:
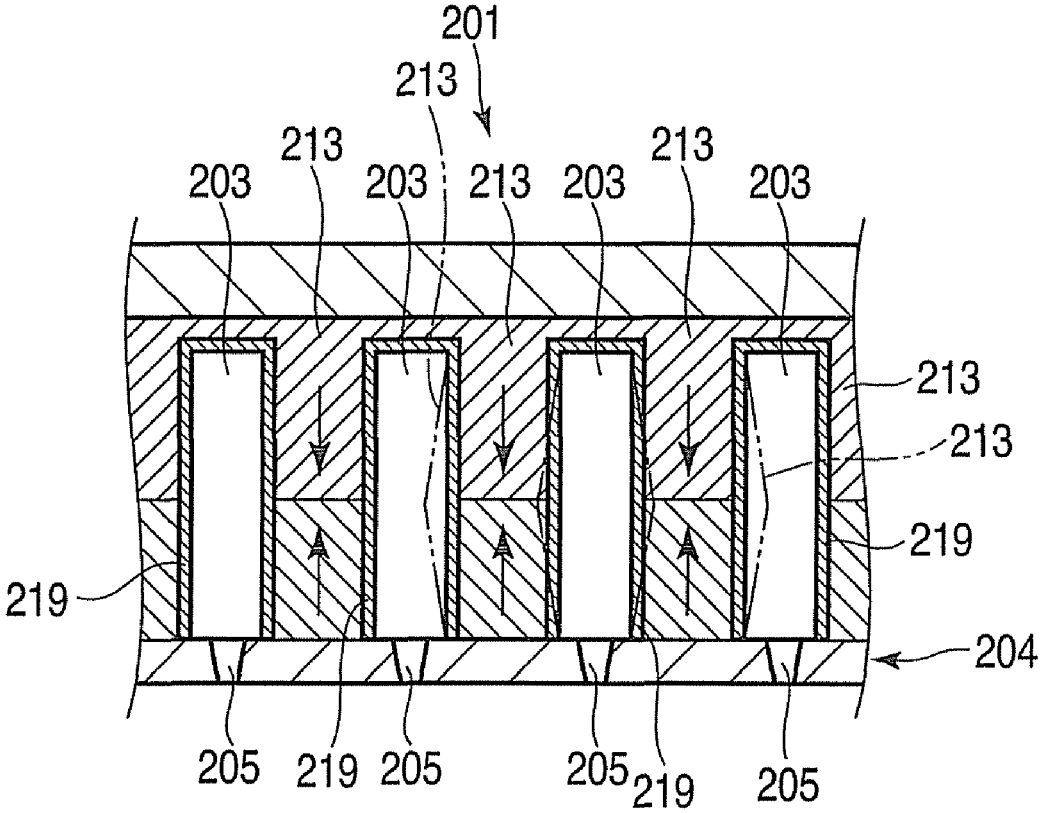
FIG. 17 is a cross-sectional view of the inkjet head shown in FIG. 14 taken along line F17-F17.

In the inkjet recording apparatus 11 configured as described above, ejection of liquid droplets is performed in the following manner. That is, the control section 15 outputs a print signal to the inkjet head 201, i.e., to the driver IC. On receiving the print signal, the driver IC applies a drive pulse voltage to the supports 213 through electrical wiring. As a result of this, the pair of supports (right and left) 213 effect shear mode deformation to bend and break away from each other as indicated by two-dot chain lines in FIG. 17. Further, the deformed supports are then restored to the initial positions, whereby the liquid in the liquid chamber 203 is pressurized, and liquid droplets are ejected from the nozzle 205 vigorously.

On the other hand, when ejection of liquid droplets is repeated, mist is caused around the nozzle 205, and the mist adheres to the nozzle plate 204 to produce adhered liquid 225, 226 as shown in FIG. 16. If the adhered liquid 225, 226 is left as it is, the ejection direction of the liquid droplets ejected from the nozzle 205 is crooked or ejection failure is caused. In the inkjet head 201 of this embodiment, the adhered liquid 225 adhering to the nozzle plate 204 is gathered up from the liquid-repellant area 204A toward the lyophilic area 204B. The adhered liquid 225 gathered up at the lyophilic area 204B is drawn into the liquid chamber 203 kept under the negative pressure through the first groove section 207 and the first liquid collection hole 206. At this time, the first groove section 207 communicates with the first liquid collection hole 206, and hence force for drawing liquid (capillary action) is exerted in the first groove section 207, and the liquid is efficiently collected into the first liquid collection hole 206. Further, as for the adhered liquid 225 which is not guided to the first groove section 207, the force for drawing the liquid (capillary action) is exerted at the gap 218 between the nozzle plate 204 and the protective cover 214, and hence the adhered liquid 225 is also efficiently collected into the first liquid collection hole 206.

Further, the adhered liquid 226 adhering to the second surface 222 of the duplication section 215 of the protective cover 214 is collected into the liquid chamber 203 through the second liquid collection hole 223, the gap 218, and the first liquid collection hole 206. At this time, the second liquid collection hole 223 communicates with the first liquid collection hole 206 through the gap 218, and hence the suction force from the first liquid collection hole 206 is transmitted to the second liquid collection hole 223, and the liquid is efficiently collected from the second liquid collection hole 223.

By virtue of the effects described above, the adhered liquid 225, 226 is continuously removed on the nozzle plate 204 and the protective cover 214. As a result of this, in this embodiment, the number of times of execution of maintenance work such as wiping on the nozzle plate 204 is made very small as compared with an ordinary inkjet recording apparatus.

Figure 18:
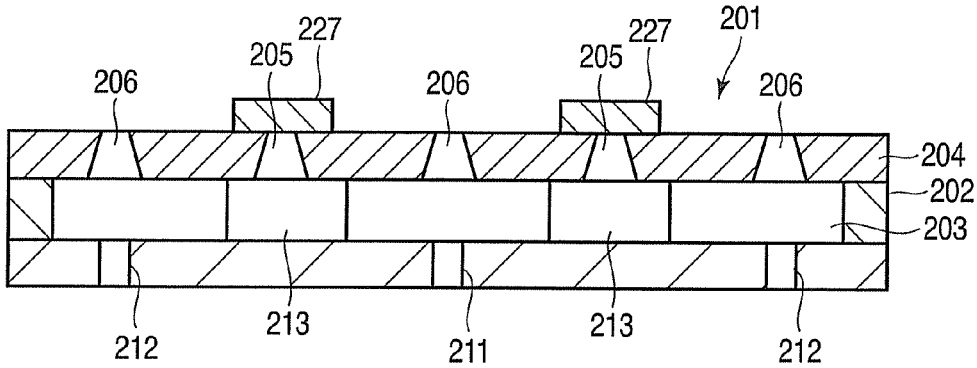
FIG. 18 is a cross-sectional view showing a first step of the manufacturing process of the inkjet head shown in FIG. 16.
Figure 19:
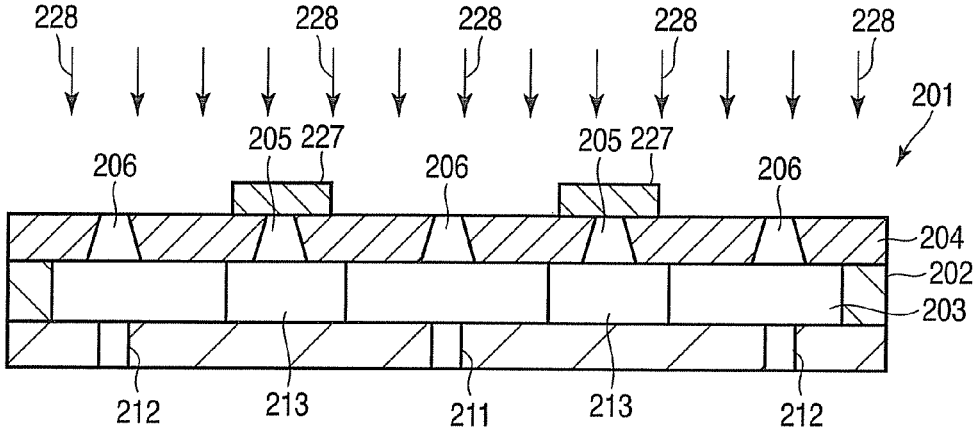
FIG. 19 is a cross-sectional view showing the next step of the manufacturing step of the inkjet head shown in FIG. 18.
Figure 20:
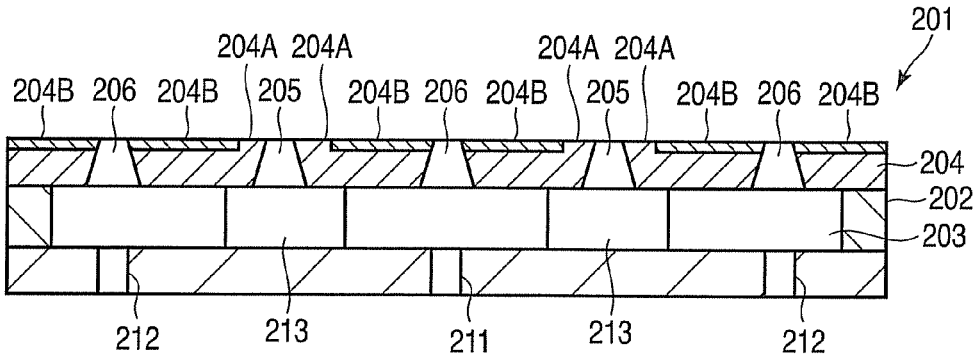
FIG. 20 is a cross-sectional view showing the next step of the manufacturing step of the inkjet head shown in FIG. 19.

Subsequently, the manufacturing process of the nozzle 205, the first liquid collection hole 206, the lyophilic area 204B, and the liquid-repellent area 204A which are formed on the nozzle plate 204 in the inkjet head 201 of this embodiment will be described below with reference to FIGS. 18 to 20.

In the inkjet head 201 of this embodiment, the nozzle 205, and the first liquid collection hole 206 are collectively formed by subjecting the nozzle plate 204 to laser processing in a state where the nozzle plate 204 is bonded to the head main body 202. In this laser processing, for example, an excimer laser is used. However, the laser used in the laser processing is not limited to this. Any type of laser may be used as long as the laser has a short wavelength. The type of laser that can be used in the laser processing for the nozzle 205, and the first liquid collection hole 206 is, in addition to the excimer laser, the YAG 3rd harmonic laser (335 nm), YAG 4th harmonic laser (266 nm) or the like. It is desirable that the excimer laser be used for the processing of the nozzle 205 requiring fine accuracy, and the YAG laser or the like be used for the processing of the first groove section 207, and the first liquid collection hole 206 from the viewpoint of processing efficiency.

Subsequently, the liquid-repellent area 204A, and the lyophilic area 204B are formed on the nozzle plate 204. As shown in FIG. 18, a film member that does not transmit ultraviolet light such as a polyimide film 227 is stuck around the nozzle 205. In this state, where masking has been performed by using the polyimide film 227, the nozzle plate 204 is subjected to surface property modification by being irradiated with ultraviolet light 228 as shown in FIG. 19. As a result of this, the lyophilic area 204B is formed on the nozzle plate 204. Further, as shown in FIG. 20, by thereafter removing the polyimide film 227 from the nozzle plate 204, the liquid-repellent area 204A having liquid repellency is formed on the nozzle plate 204. As a result of the above, the liquid-repellent area 204A, and the lyophilic area 204B are formed on the nozzle plate 204. According to this embodiment, it is possible to form a lyophilic area 204B easily and in a wide range by irradiating the nozzle plate 204 with ultraviolet light.

It should be noted that, in this embodiment, masking is performed by using a polyimide film 227. However, the masking method is not limited to this. As another masking method, a glass mask designed in such a manner that ultraviolet light is not transmitted at a part corresponding to the liquid-repellent area 204A may be used. In this case, the masking method of the contact type in which the glass mask is brought into contact with the nozzle plate 204 may be used, and the masking method of the non-contact type in which the glass mask is not brought into contact with the nozzle plate 204 may also be used. Ultraviolet light is irradiated by using one of the masking method of the contact type, and the masking method of the non-contact type, whereby the liquid-repellent area 204A, and the lyophilic area 204B are formed on the nozzle plate 204.

The fifth embodiment of the inkjet recording apparatus 11 has been described above. According to this embodiment, the inkjet recording apparatus 11 includes the inkjet head 201 for ejecting liquid, tanks in which liquid to be supplied to the inkjet head 201 is retained, and flow paths for connecting the inkjet head 201 and the tanks. The inkjet head 201 includes the head main body 202, the liquid chambers 203 which are built in the head main body 202, and in which liquid is kept under the negative pressure, the nozzle plate 204 bonded to the head main body 202 in such a manner that the plate 204 constitutes one wall part of each of the liquid chambers 203, the nozzles 205 formed in the nozzle plate 204 in such a manner that the nozzles 205 communicate with the liquid chambers 203, the drive elements for causing the nozzles 205 to eject liquid droplets, and the first liquid collection holes 206 formed in the nozzle plate 204 in such a manner that the holes 206 communicate with the liquid chambers 203. The nozzle plate 204 includes the liquid-repellent areas 204A formed around the nozzles 205, the lyophilic area 204B which is formed around the liquid-repellent areas 204A, and in which the first liquid collection holes 206 are arranged, and the first groove section 207 which is provided in the lyophilic area 204B so as to surround the liquid-repellent areas 204B, is formed depressed with respect to the surface of the lyophilic area 204B, and communicates with the first liquid collection holes 206.

According to the configuration described above, liquid is kept under the negative pressure in the liquid chamber 203, and hence, when liquid adheres to the nozzle plate 204, this adhered liquid is drawn into the liquid chamber 203 from the first liquid collection hole 206. As a result of this, by removing the liquid adhering to the nozzle plate 204, it is possible to prevent ejection failure and ejection direction crookedness caused by the adhered liquid from occurring. Further, the lyophilic area 204B and the liquid-repellent area 204A are provided on the nozzle plate 204, and hence it is possible to gather up the liquid adhering to the nozzle plate 204 to the lyophilic area 204B, and efficiently collect the liquid from the first liquid collection hole 206. Further, the first groove section 207 is provided in the lyophilic area 204B to surround the liquid-repellent areas 204A, and hence it is possible to cause the suction force exerted on the first liquid collection hole 206 from the liquid chamber 203 to be exerted even on the lyophilic area 204B through the first groove section 207. As a result of this, it is possible to collect the liquid on the lyophilic area 204B more efficiently. As described above, in the inkjet recording apparatus 11 of this embodiment, liquid is routinely drawn from the first liquid collection hole 206, and hence the number of times of execution of maintenance such as wiping on the inkjet head 201 can be reduced. As a result of this, the interval between maintenance operations is prolonged, and the printing speed can therefore be made higher. It should be noted that, although the adhered liquid 225, 226 adhering to the nozzle plate 204 is returned to the liquid chamber 203, the ratio of the amount of the adhered liquid to the amount of the liquid inside the liquid chamber 203 is small, and hence the influence of the adhered liquid is extremely small. Further, the amount of liquid adhering to the nozzle plate 204 becomes small, and hence, the configuration of the wiping device or the like of the maintenance device can be made simple.

In this case, the inkjet head 201 includes the protective cover 214 provided with the duplication section 215 for covering the surface of the nozzle plate 204 with a gap 218 held between itself and the nozzle plate 204, and the opening sections 216 provided at positions corresponding to the nozzles 205. According to this configuration, it is possible to prevent the sheet-like recording medium 17 or the like from coming into contact with the nozzle plate 204 by the protective cover 214. As a result of this, it is possible to prevent the nozzles 205 from being hurt by the sheet-like recording medium or the like. Further, the opening sections 216 are provided, and hence, it is needless to say that the ejection of liquid from the nozzles 205 is never hindered by the protective cover 214.

In this case, the first liquid collection hole 206 is opened at a position on the nozzle plate 204 overlapping the duplication section 215. According to this configuration, it is possible to cause the suction force exerted on the first liquid collection hole 206 to be also exerted on the gap 218 between the duplication section 215 and the nozzle plate 204. As a result of this, even when liquid adheres to the gap 218 between the duplication section 215 and the nozzle plate 204, it is possible to collect the adhered liquid 225 into the liquid chamber 203 through the first liquid collection hole 206.

In this case, the protective cover 214 includes the first surface 221 opposed to the nozzle plate 204, the second surface 222 on the opposite side of the first surface 221, and the second liquid collection holes 223 provided in the duplication section 215 to penetrate the first surface 221 and the second surface 222. According to this configuration, the second liquid collection hole 223 communicates with the gap 218 between the nozzle plate 204 and the duplication section 215. Accordingly, it is possible to cause the suction force from the first liquid collection hole 206 exerted on the gap 218 to be also exerted on the second liquid collection hole 223. As a result of this, it is possible to collect the adhered liquid 226 adhering to the second surface 222 of the protective cover 214 into the liquid chamber 203 through the second liquid collection hole 223, the gap 218, and the first liquid collection hole 206.

In this case, the protective cover 214 includes the second groove section 224, and the second groove section 224 is provided in the duplication section 215 depressed from the second surface 222, surrounds the opening sections 216, and communicates with the second liquid collection holes 223. According to this configuration, it is possible to cause the suction force exerted on the second liquid collection hole 223 to be also exerted on the second groove section 224. As a result of this, the adhered liquid 226 adhering to the second surface 222 of the protective cover 214 can also be efficiently collected into the liquid chamber 203.

It should be noted that the inkjet head 201 according to this embodiment is constituted of circulative elements in which liquid is circulated. However, even in an inkjet head constituted of non-circulative elements in which liquid is not circulated, the structure of this embodiment can be employed.

The present invention is not limited to the embodiments described above. Needless to say, besides, the present invention can be variously modified and implemented within the scope not deviating from the gist of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and equivalents thereof.

What is claimed is:

1. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section; and wherein the inkjet head includes a second suction hole, and the second suction hole is formed in the nozzle plate independently of the liquid chamber, and draws extraneous matter adhering to the nozzle plate.

2. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section;

wherein the inkjet head includes a second suction hole, and the second suction hole is formed in the nozzle plate independently of the liquid chamber, and draws extraneous matter adhering to the nozzle plate; and a suction device for drawing the extraneous matter through the second suction hole.

3. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section;

wherein the inkjet head includes a second suction hole, and the second suction hole is formed in the nozzle plate independently of the liquid chamber, and draws extraneous matter adhering to the nozzle plate;

a suction device for drawing the extraneous matter through the second suction hole; and wherein the diameter of the second suction hole is greater than that of the nozzle.

4. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section;

wherein the inkjet head includes a second suction hole, and the second suction hole is formed in the nozzle plate independently of the liquid chamber, and draws extraneous matter adhering to the nozzle plate;

a suction device for drawing the extraneous matter through the second suction hole;

wherein the diameter of the second suction hole is greater than that of the nozzle; and wherein the nozzle plate includes liquid-repellent areas formed around the nozzles, and lyophilic areas formed around the first suction holes and the second suction holes.

5. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section;

wherein the inkjet head includes a second suction hole, and the second suction hole is formed in the nozzle plate independently of the liquid chamber, and draws extraneous matter adhering to the nozzle plate;

a suction device for drawing the extraneous matter through the second suction hole;

wherein the diameter of the second suction hole is greater than that of the nozzle;

wherein the nozzle plate includes liquid-repellent areas formed around the nozzles, and lyophilic areas formed around the first suction holes and the second suction holes; and wherein the liquid-repellent area is formed by covering an entire surface of the nozzle plate with a liquid-repellent layer, and the lyophilic area is formed by peeling off a part of the liquid-repellent layer by laser processing.

6. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section;

wherein the inkjet head includes a second suction hole, and the second suction hole is formed in the nozzle plate independently of the liquid chamber, and draws extraneous matter adhering to the nozzle plate;

a suction device for drawing the extraneous matter through the second suction hole;

wherein the diameter of the second suction hole is greater than that of the nozzle;

wherein the nozzle plate includes liquid-repellent areas formed around the nozzles, and lyophilic areas formed around the first suction holes and the second suction holes;

wherein the liquid-repellent area is formed by covering an entire surface of the nozzle plate with a liquid-repellent layer, and the lyophilic area is formed by peeling off a part of the liquid-repellent layer by laser processing; and wherein the lyophilic area is formed sunken with respect to the liquid-repellent area.

7. An inkjet recording apparatus comprising:

an inkjet head;

a tank in which liquid to be supplied to the inkjet head is retained; and a flow path for connecting the inkjet head and the tank to each other, wherein the inkjet head includes a head main body;

liquid chambers which are built in the head main body, and in which liquid is kept under negative pressure;

a nozzle plate bonded to the head main body in such a manner that the plate constitutes one wall part of each of the liquid chambers;

nozzles formed in the nozzle plate in such a manner that the nozzles communicate with the liquid chambers;

drive elements for causing the nozzles to eject liquid droplets;

first suction holes formed in the nozzle plate in such a manner that the holes communicate with the liquid chambers;

wherein the diameter of the first suction hole is less than or equal to that of the nozzle;

wherein the flow path includes a first part for supplying liquid from the tank to the inkjet head; and a second part for collecting liquid from the inkjet head toward the tank, and the inkjet head includes:

a feed section built in the head main body, and connecting the liquid chambers and the first part to each other; and a discharge section built in the head main body, and connecting the liquid chambers and the second part to each other;

wherein the first suction hole communicates with the liquid chamber near the discharge section;

wherein the inkjet head includes a second suction hole, and the second suction hole is formed in the nozzle plate independently of the liquid chamber, and draws extraneous matter adhering to the nozzle plate;

a suction device for drawing the extraneous matter through the second suction hole;

wherein the diameter of the second suction hole is greater than that of the nozzle;

wherein the nozzle plate includes liquid-repellent areas formed around the nozzles, and lyophilic areas formed around the first suction holes and the second suction holes;

wherein the liquid-repellent area is formed by covering an entire surface of the nozzle plate with a liquid-repellent layer, and the lyophilic area is formed by peeling off a part of the liquid-repellent layer by laser processing;

wherein the lyophilic area is formed sunken with respect to the liquid-repellent area; and wherein the first suction holes, the second suction holes, and the lyophilic areas are collectively formed by laser processing.

* * * * *